United States Patent [19]

Kutz

[11] 4,403,359

[45] Sep. 13, 1983

[54] METHOD FOR WASHING OUT THICKENING FROM PRINTED TEXTILE MATERIALS IN WEB FORM

[75] Inventor: Johannes Kutz, Tönisvorst, Fed. Rep. of Germany

[73] Assignee: Eduard Küsters, Krefeld, Fed. Rep. of Germany

[21] Appl. No.: 282,151

[22] Filed: Jul. 10, 1981

[30] Foreign Application Priority Data

Jul. 11, 1980 [DE] Fed. Rep. of Germany ..... 3026349

[51] Int. Cl.[3] ..... D06B 5/08; D06B 15/04; D06B 21/00

[52] U.S. Cl. ..... 8/149.1

[58] Field of Search ..... 8/149.1; 68/5 D, 5 E, 68/20; 427/353, 354, 373, 394

[56] References Cited

U.S. PATENT DOCUMENTS

| | | | |
|---|---|---|---|
| 3,655,328 | 4/1972 | Sando et al. | 8/149.1 |
| 3,997,928 | 12/1976 | Leifeld | 8/149.1 |
| 4,299,591 | 11/1981 | Gregorian et al. | 8/149.1 X |

*Primary Examiner*—Philip R. Coe

*Attorney, Agent, or Firm*—Kenyon & Kenyon

[57] ABSTRACT

A method for washing out thickening from printed textile material in web form, includes: applying a foam which contains, in its foam-forming liquid, particularly water, only a wetting agent, and optionally a foaming agent, to the printed side of the textile material; working the foam into the textile material; steaming the textile material; applying either foam which contains, in its foam forming liquid, particularly water, only a wetting agent and optionally, a foaming agent, or hot water to the backside of the textile material; and applying suction to the printed side of the textile material.

4 Claims, No Drawings

METHOD FOR WASHING OUT THICKENING FROM PRINTED TEXTILE MATERIALS IN WEB FORM

BACKGROUND OF THE INVENTION

This invention relates to the treatment of textile webs in general and more particularly to a method for washing out thickening from printed textile materials in web form.

Washing printed material is always a critical process because in dissolving printing coagulation (thickening) and excess printing ink, which has not been applied, it is necessary to keep the printing ink from bleeding into the surrounding area. Such bleeding is particularly noticeable if the print is dark and the background is light. The subsequent washing of the print usually takes place in a cold condition in order to keep the tendency for bleeding low, and therefore extends over a relatively long time, which is an obstacle to a continuous process.

From U.S. Pat. No. 1,948,568, a method for treating textile material, among other things, also for washing of textile materials, is described. In this method, the treatment agents are sucked through the textile material in the form of a foam. The treatment agent is contained in the liquid which is used for making the foam and which is foamed by applying gas and is then brought into contact with the material in the form of the foam. However, U.S. Pat. No. 1,948,568 describes only discontinuous foam treatment of batch materials in a closed container.

For finishing purposes, however, the foam process has been developed as a continuous process, as can be seen from U.S. Pat. Nos. 3,042,573 and 4,023,526, as well as from DE-OS No. 22,14,377. These patents do not, however, describe washing in the course of a continuous process. In particular, a teaching concerning subsequent washing cannot be found in these publications.

It is an object of the present invention to provide a method for washing out thickening from printed textile material, in which the danger of bleeding of the print is reduced.

DESCRIPTION OF THE INVENTION

According to the present invention, this problem is solved by the following process: applying a foam which contains, in its foam-forming liquid, particularly water, only a wetting agent, and optionally a foaming agent, to the printed side of the textile material; applying a washing fluid to the backside of the textile material; and applying suction to the printed side of the textile material to remove the washing fluid. The washing fluid may be hot water or a foam forming liquid, particularly water with only a wetting agent and, optionally, a foaming agent.

The quantity of liquid which forms the foam and is worked into the textile material, leads to a swelling of the thickening in the process of steaming, which aids its dissolution and removal after the second addition of liquid in the form of foam or hot water during the final suctioning step. It is understood that a liquid in which the thickening can swell is used. Normally this would be water.

It is important in this connection that the thickening does not have to be pushed through the textile material, but can be taken away again from the side of application.

Tests have shown that it was possible to remove the larger part of the thickening and the excess ink by this method, and the water consumption is very low. Customarily, printed and steamed textiles are washed in winch vats or full-width washing machines. For washing out thickening, chemicals and the unfixed inks, ten to thirty liters of water per kilogram of material are used, depending on the type of fiber and the composition of the ink. According to the new foam washing technique, the same task can be accomplished with a water consumption which is only 10–20% of this value.

Working the foam in is advantageously done likewise by suction from the back side of the textile material.

Foam is applied to the continuously advancing web of the textile material in a uniform layer. The thickness of the layer applied is determined by the amount of water and chemicals. The application can be performed with any device known for this purpose. Suctioning is accomplished by means of suction nozzles extending transversely across the web.

I claim:

1. A method for washing out thickening from printed textile material in web form, comprising: applying a foam which contains in its foam-forming liquid, particularly water, only a wetting agent and optionally a foaming agent to the printed side of the textile material; working the foam into the textile material; steaming the textile material; applying a washing fluid to the backside of the textile material; and applying suction to the printed side of the textile material to remove said washing fluid.

2. The method according to claim 1, wherein said step of working the foam in comprises suctioning the foam in from the backside of the textile material.

3. The method according to claim 1 or 2 wherein said washing fluid comprises a foam which contains, in its foam forming liquid, particularly water, only a wetting agent and optionally, a foaming agent.

4. The method according to claim 1 or 2 wherein said washing fluid comprises hot water.

* * * * *